US007371142B2

(12) United States Patent
Pianezzola et al.

(10) Patent No.: US 7,371,142 B2
(45) Date of Patent: May 13, 2008

(54) BUOYANCY COMPENSATOR DEVICE, PARTICULARLY FOR DIVERS

(75) Inventors: Sergio Pianezzola, Calcinate Del Pesce (IT); Augusto Contardi, Varese (IT)

(73) Assignee: Spark, S.R.L., Varese (IT)

( * ) Notice: Subject to any disclaimer, the term of this patent is extended or adjusted under 35 U.S.C. 154(b) by 0 days.

(21) Appl. No.: 10/523,441

(22) PCT Filed: Aug. 4, 2003

(86) PCT No.: PCT/EP03/08614

§ 371 (c)(1),
(2), (4) Date: May 5, 2005

(87) PCT Pub. No.: WO2004/014725

PCT Pub. Date: Feb. 19, 2004

(65) Prior Publication Data

US 2006/0063448 A1 Mar. 23, 2006

(30) Foreign Application Priority Data

Aug. 5, 2002 (IT) ..... MI2002A1770

(51) Int. Cl.
*B63C 9/15* (2006.01)

(52) U.S. Cl. ..... 441/90; 405/186

(58) Field of Classification Search ..... 441/90, 441/92, 96, 111, 102; 405/185, 186, 193, 405/187

See application file for complete search history.

(56) References Cited

U.S. PATENT DOCUMENTS

| | | | | |
|---|---|---|---|---|
| 4,009,583 | A * | 3/1977 | Buckle | 405/186 |
| 4,137,585 | A | 2/1979 | Wright | 405/193 |
| 5,346,419 | A * | 9/1994 | Kaiser | 441/96 |
| 6,217,257 | B1 * | 4/2001 | Garofalo et al. | 405/186 |
| 6,749,369 | B2 * | 6/2004 | Garofalo | 405/186 |

FOREIGN PATENT DOCUMENTS

| | | |
|---|---|---|
| EP | 921 064 A | 6/1999 |
| EP | 921 066 A | 6/1999 |
| EP | 945 339 A | 9/1999 |
| EP | 1 136 351 A | 9/2001 |

* cited by examiner

*Primary Examiner*—Lars A Olson
(74) *Attorney, Agent, or Firm*—R. Neil Sudol; Henry D. Coleman; William J. Sapone

(57) ABSTRACT

A buoyancy compensator device for divers has an expandable air chamber and at least two outlets, one arranged in an upper region and one arranged in a lower region. A manifold functionally connects the expandable air chamber and the outlets, by means of a control valve. A manifold connects the expandable air chamber to the outlets and has a control valve.

7 Claims, 5 Drawing Sheets

BUOYANCY COMPENSATOR DEVICE, PARTICULARLY FOR DIVERS

BACKGROUND OF THE INVENTION

The present invention relates to a buoyancy compensator device for divers.

The buoyancy compensator device (BCD) is a jacket used by a diver during dives with a self-contained underwater breathing apparatus (SCUBA) in order to adjust his or her buoyancy.

The BCD is useful because buoyancy varies according to depth, and the diver can adjust his or her buoyancy by inflating or deflating the BCD.

For this purpose, conventional BCDs are provided with a corrugated hose that is applied in an upper position of the jacket and whose free end has a manual control, connected to a high pressure line, for introducing and discharging air.

While air can be introduced with the control valve in any position, discharging the air from the jacket requires the end of the corrugated hose, to which the discharge valve is applied, to be always in a higher position, i.e., at a shallower depth, than the jacket.

In practice, the diver can discharge air from the jacket only in an upright head-up position by lifting the end of the corrugated hose above his or her shoulders.

There are situations in which the diver cannot assume the upright position to discharge the air from the jacket, for example in confined passages, in a cave, inside a shipwreck, or when it is necessary to remain motionless in order to avoid frightening marine animals, typically during filming or photographing.

Since even small depth variations cause a considerable variation in buoyancy, a loss of control of buoyancy is always awkward and in some cases dangerous.

Some jackets have a discharge valve that is arranged on the lower side and is provided with an actuation cord that allows to discharge air when the diver is upside down; however, actuation of the lower valve is not easy and in some conditions may not be accessible.

EP-0921064 discloses a buoyancy compensator device provided with four valves, two upper ones and two lower ones, that, by means of a single pneumatic control, allow to discharge air in any position of the diver. The buoyancy compensator device described in that patent is relatively complicated from a constructive standpoint because each valve unit is constituted by a pneumatic valve and by a one-way membrane that prevents water from entering the jacket during air discharge. That constructive complexity entails accurate maintenance and also greater care and attention during use.

Any malfunction of a device during a dive can be fatal, and the diver generally prefers devices that are constructively simple and tough, and accordingly more reliable, in view of the fact that underwater equipment is often used in difficult environmental conditions and far from specialized workshops equipped with spare parts.

The aim of the present invention is to provide a buoyancy compensator device that overcomes the drawbacks of the cited prior art.

OBJECTS OF THE INVENTION

An object of the invention is to provide a buoyancy compensator device that allows to discharge air in any position assumed by the diver.

Another object of the invention is to provide a buoyancy compensator device that is constructively simple and extremely reliable.

Another object is to provide a buoyancy compensator device that is functionally simple even for less expert users.

This aim and these and other objects that will become better apparent hereinafter are achieved by a buoyancy compensator device, as claimed in the appended claims.

BRIEF DESCRIPTION OF THE DRAWINGS

Further characteristics and advantages will become better apparent from the description of preferred but not exclusive embodiments of the invention, illustrated by way of non-limitative example in the accompanying drawings, wherein.

DETAILED DESCRIPTION OF PREFERRED EMBODIMENTS

Figure 1:
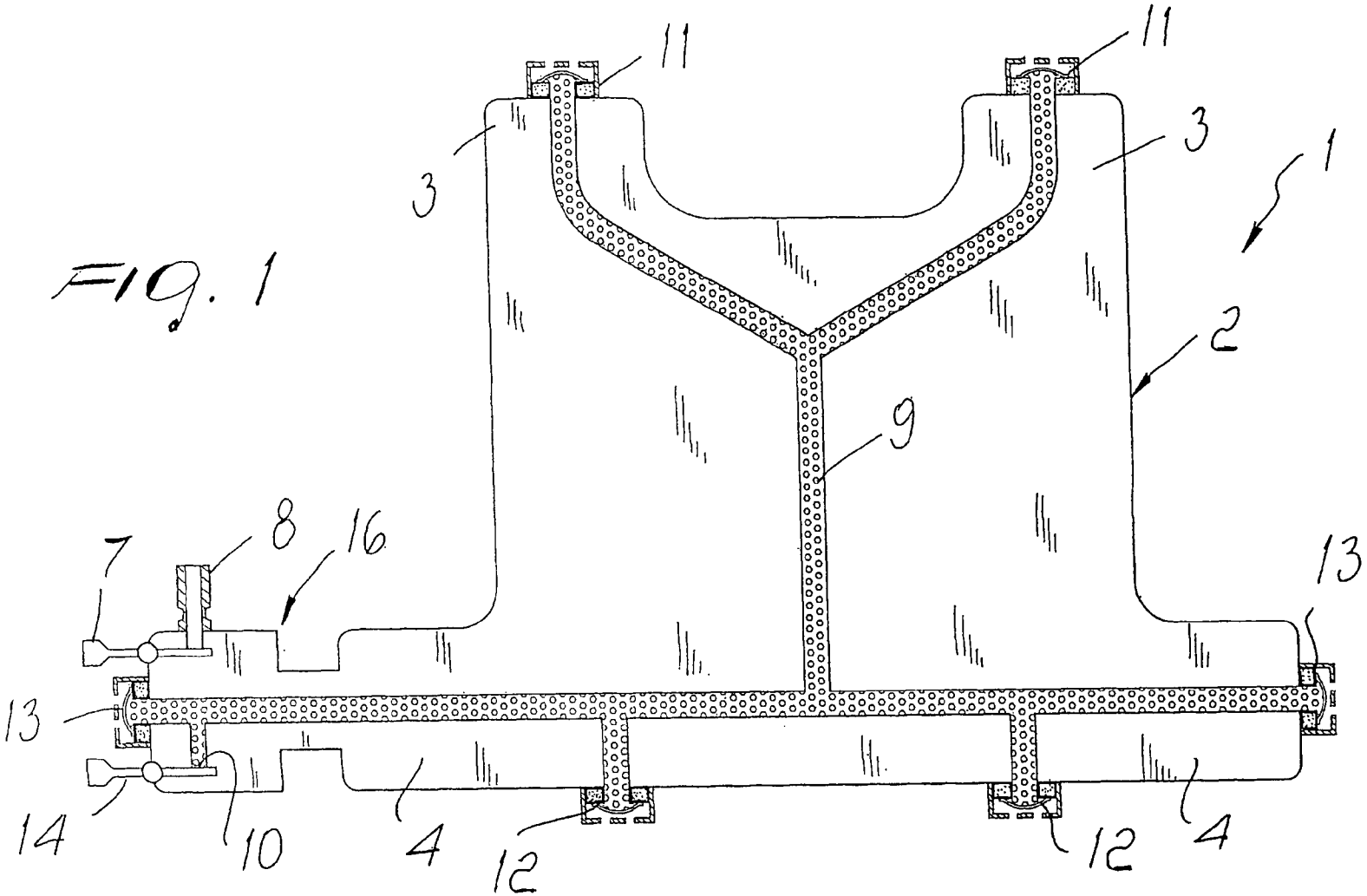
FIG. 1 is a schematic view of a buoyancy compensator device according to the invention, in form of a jacket and shown in the flattened configuration.

With reference to the cited figures, a buoyancy compensator device according to the invention, generally designated by the reference numeral 1, is constituted by a jacket or vest 2 that can be of the conventional type and is therefore provided with two shoulders 3 that are connected, by adjustable straps not shown in the drawings, to a lower band 4 that surrounds the waist of the diver.

The vest is an expandable chamber which can be filled with gas, typically by using the breathable gas mixture contained in the tank or tanks 6 of the self-contained breathing apparatus, by means of a mechanical inflator, which includes an inlet 8, connected to the bottle by means of a hose, not shown, and is actuated by a pushbutton control 7.

Figure 5:
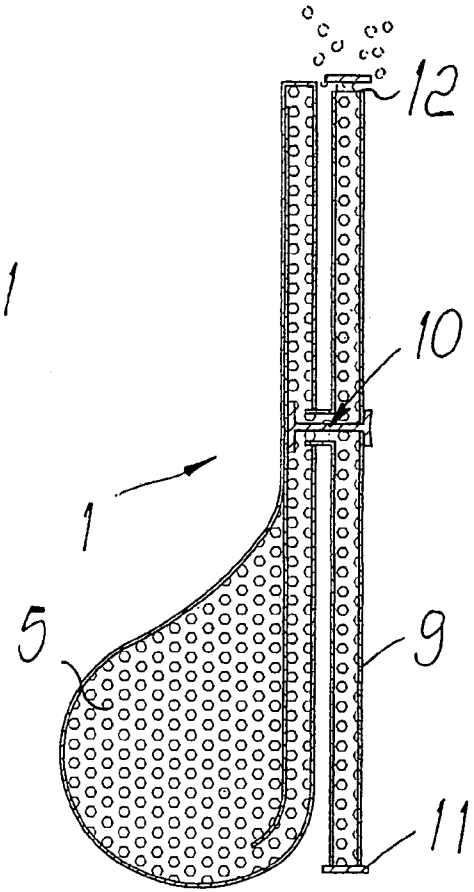
FIG. 5 is a view, similar to FIG. 4, of the deflation step, but in the upside down position.
Figure 4:
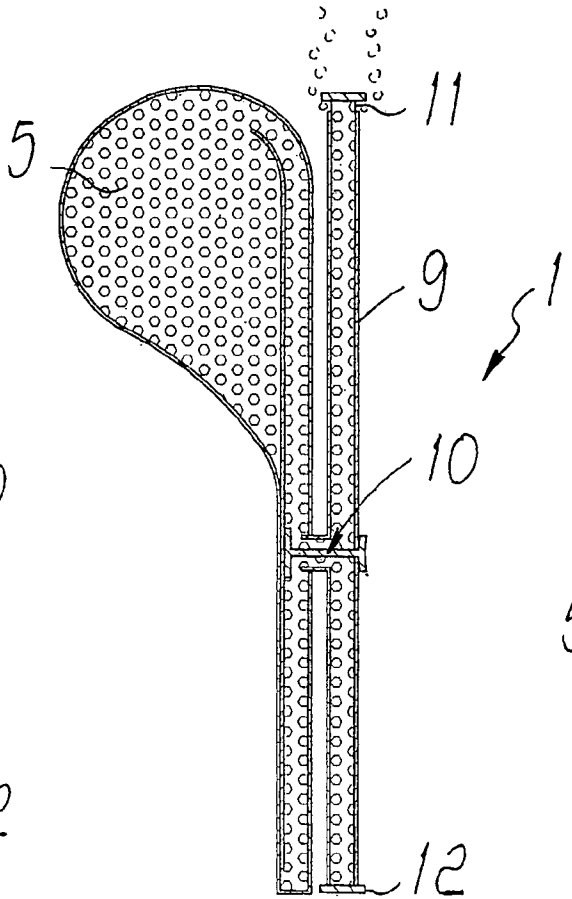
FIG. 4 is a view, similar to FIG. 3, but illustrating the deflation step in an upright position.
Figure 3:
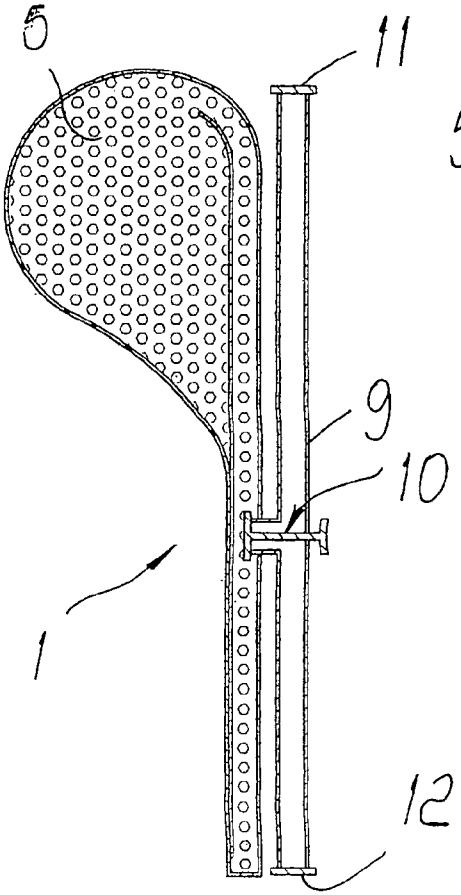
FIG. 3 is a schematic side elevation view of the operation of the jacket in the inflated condition.

In FIGS. 3 to 5 the expandable chamber is schematically represented and designated by the reference numeral 5.

Figure 2:
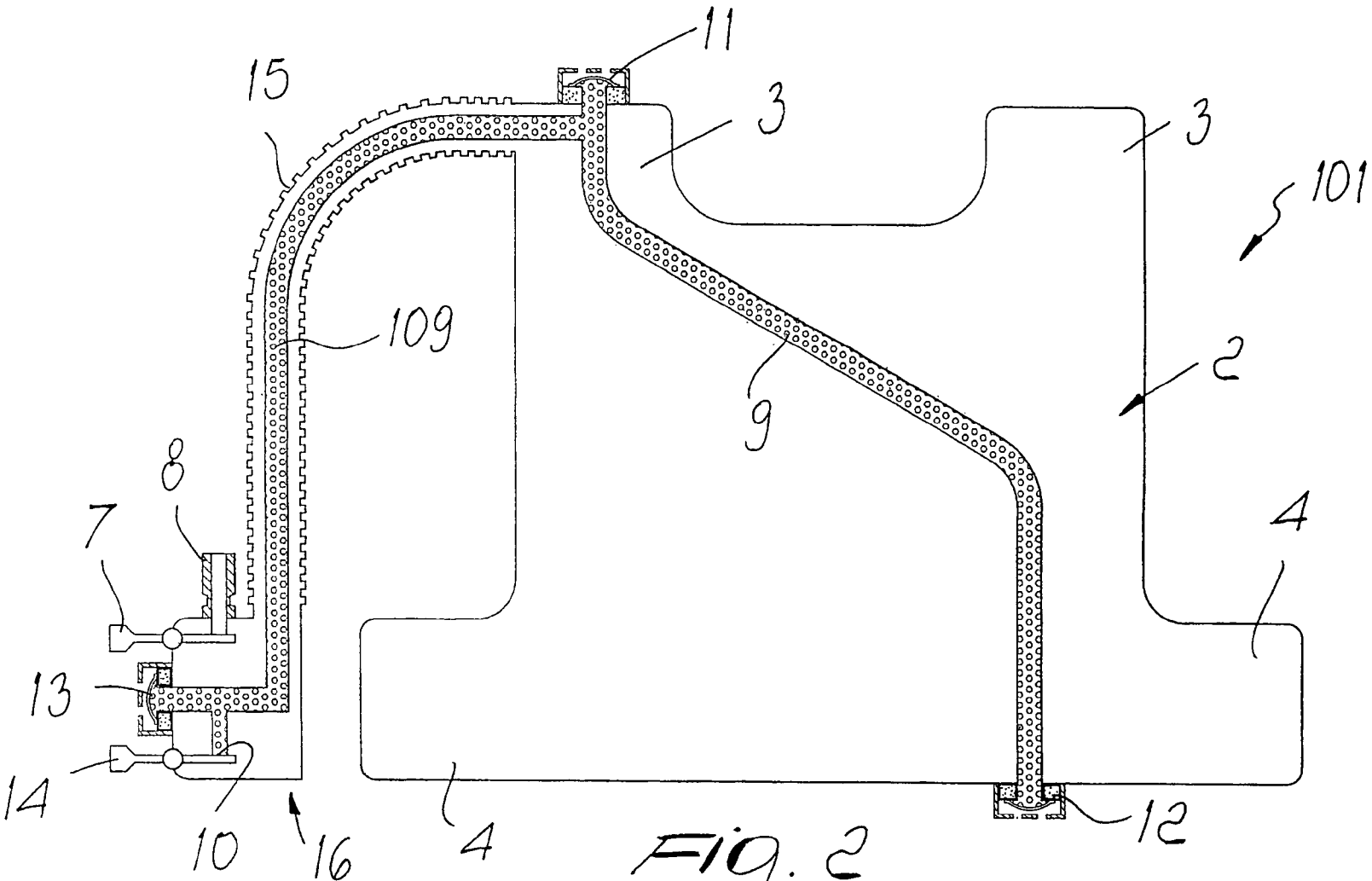
FIG. 2 is a view, similar to FIG. 1, of a jacket according to a further aspect of the invention.
Figure 7:
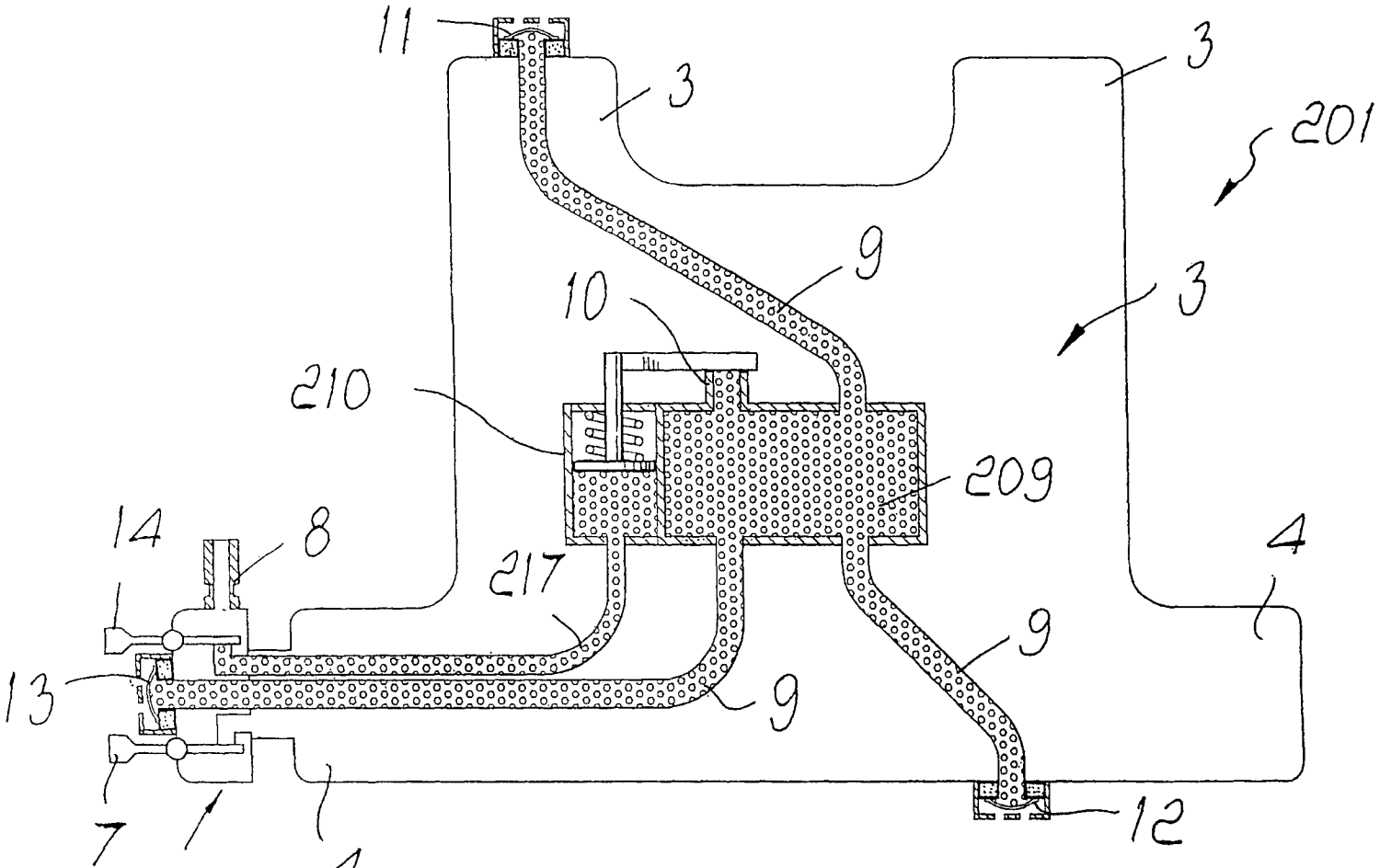
FIG. 7 is a view, similar to FIG. 6, of a jacket according to a further aspect of the invention.

According to the invention, the jacket has a manifold, schematically designated by the reference numeral 9 in FIGS. 3 to 5, which is connected to the expandable air chamber 5 by means of a control valve 10 and is provided with at least one upper outlet 11 and one lower outlet 12, which are constituted by a simple one-way membrane, as shown schematically in FIGS. 1, 2 and 7.

By opening the control valve 10, the gas mixture contained in the expandable chamber 5 passes into the manifold 9 and exits from the upper outlet 11, while the lower one-way membrane 12 remains closed, since the external pressure is higher at the membrane because it is at a greater depth.

Vice versa, if the jacket is upside down, the greatest pressure occurs at the upper one-way membrane 11, which remains closed, and the air exits from the lower outlet 12, which in the upside-down position is at a shallower depth.

FIGS. 1, 2 and 7 schematically illustrate three possible embodiments of the jacket according to the invention.

The jacket 1, shown in FIG. 1, has a manifold that is constituted by a tubular element 9 that connects two upper one-way membranes 11, two lower one-way membranes 12 and two lateral one-way membranes 13, which are arranged at the ends of the lower band 4; one of the membranes, designated by the reference numeral 16, includes the pushbutton inflator control 7 and a control pushbutton 14 that actuates the controlled discharge valve 10.

Figure 6:
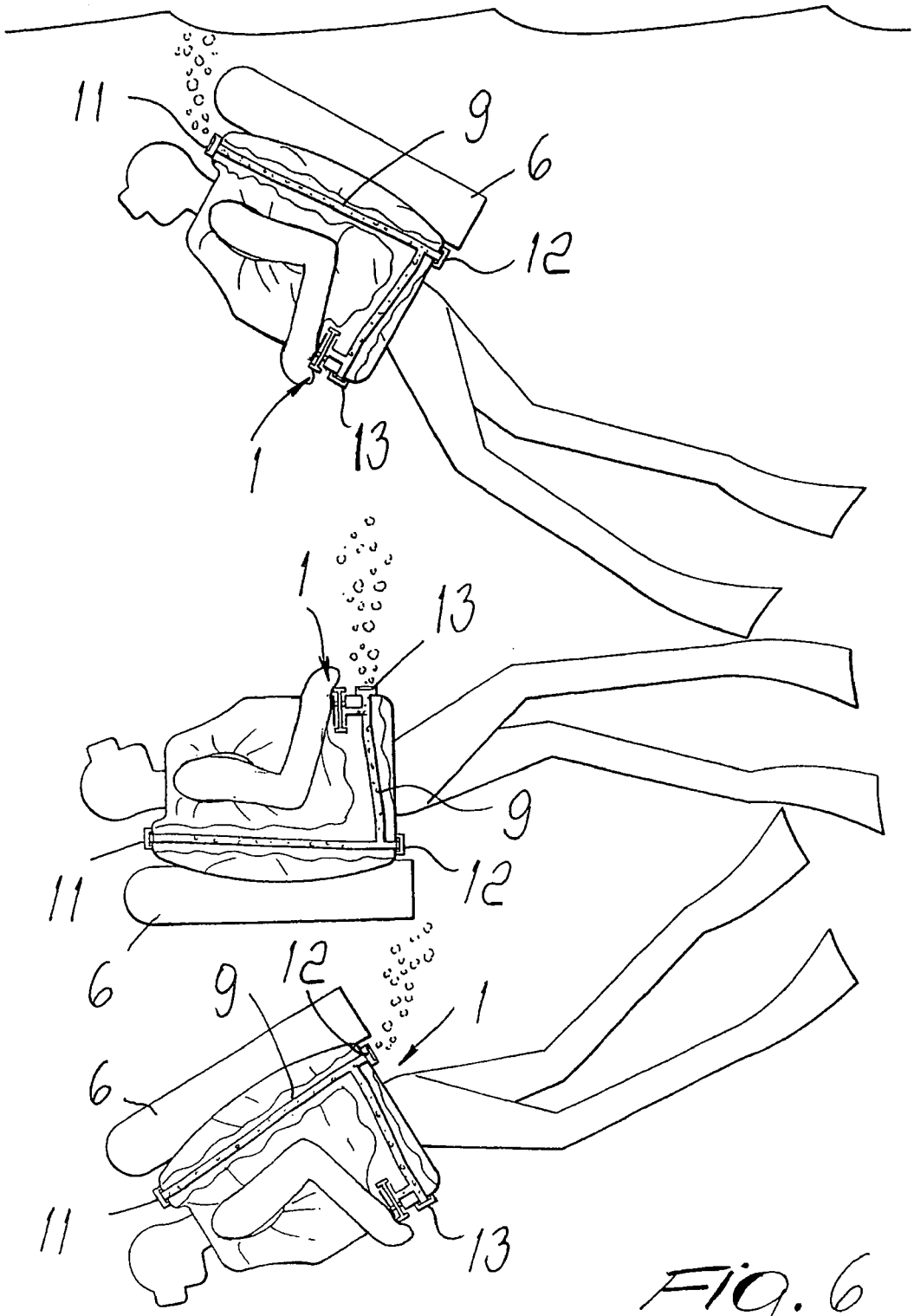
FIG. 6 is a schematic view of three positions of a diver during the deflation of the jacket according to the invention.

With this arrangement of the one-way membranes 11, 12 and 13, regardless of the position assumed by the diver, one of the membranes is always in an upper position in order to discharge the gas mixture, as shown schematically in FIG. 6.

The jacket 101, shown in FIG. 2, has a manifold that is constituted by a tubular element 9 that connects an upper one-way membrane 11, a lower one-way membrane 12 and a lateral one-way membrane 13, which is arranged at the end of a corrugated hose 15 that is associated with the expandable chamber and accommodates a part 109 of the manifold 9.

The end 16 of the corrugated hose 15 includes the pushbutton inflator control 7 and the control pushbutton 14 that actuates the controlled discharge valve 10, which is also arranged in the end 16.

The jacket 201, shown in FIG. 7, has a manifold that is constituted by a central body 209 and by tubular members 9, which are connected respectively to a one-way membrane 11, a lower one-way membrane 12 and a lateral one-way membrane 13, which is arranged at an end 216 of the lower band 4.

The end 216 includes the pushbutton inflator control 7 and the control pushbutton 14, which actuates the controlled valve 10 by virtue of a pneumatic system.

The control valve 10 is in fact located at the central body 209 and is actuated by a servo control.

The servo control can be constituted, for example, by a pneumatic servo control 210 that is supplied, by means of a duct 217, by the gas mixture that arrives from the tank through the control pushbutton 14.

The servo control can also be provided by means of other systems of the hydraulic, electrical, mechanical type and of other types.

The illustrated embodiments are merely an indication of the many possible configurations and arrangements of the one-way membranes and of the manifold.

In turn, the manifold can be provided inside the vest or externally and can be shaped like a tube and separate from the vest, or, constituted by portions of the vest.

The expandable chamber is constructed so that it always ensures the free circulation of the gaseous mixture, so that it can always reach the discharge valve.

This can be achieved in various manners with particular refinements in the manufacture of the vest by using for example materials that have internal protrusions or corrugations that prevent the two sheets from adhering, preventing the passage of the gaseous mix.

The vest can have various shapes and the invention is applicable in general to any inflatable device that allows the diver to control his or her buoyancy.

The buoyancy compensator device according to the present invention can be manufactured according to currently applicable standards regarding diving equipment.

In practice it has been found that the invention achieves the intended aim and objects, a buoyancy compensator device having been provided which allows the diver to discharge air, regardless of his or her position, simply by acting on a pushbutton that can be located in the most comfortable position.

An important advantage is constituted by the use of outlets that are not constituted by complicated valves but by simple one-way membranes, which are already widely used and tested in underwater equipment. The maintenance required for these one-way membranes is limited and extremely simple, and their inherent constructive simplicity makes them practically free from malfunctions.

The constructive and mechanical simplicity of the device according to the present invention is comparable with that of conventional jackets, and this makes the jacket cheap and reliable, accordingly facilitating its diffusion.

The buoyancy compensator device according to the present invention is extremely advantageous for the expert diver, in particular diving conditions, but also for the beginner, since the venting maneuver is extremely simplified with respect to conventional jackets.

In practical use, the diver in fact merely has to operate alternately the inflation and deflation pushbuttons, which are advantageously arranged adjacent in a handy position, for example at the waist, in order to adjust buoyancy, without worrying about having to perform any other maneuver and regardless of his or her position in the water.

A further advantage of the present invention is constituted by the possibility to modulate the outlet, differently from what occurs in the valve system described in the introduction, which allows only two positions: fully closed or fully open, forcing the diver to act with frequent violent impulses to discharge the jacket. In the present invention it is instead possible to modulate the outflow of the air by acting on the discharge valve.

The jacket according to the invention is susceptible of numerous modifications and variations, within the scope of the appended claims. All the details may be replaced with technically equivalent elements.

The materials used, as well as the dimensions, may of course be any according to requirements and to the state of the art.

What is claimed is:

1. A buoyancy compensator device, comprising an expandable air chamber and at least two outlets, one arranged in an upper region and one arranged in a lower region, wherein:

a manifold connects said expandable air chamber to said outlets by means of a control valve;

said expandable air chamber is a vest and is provided with two shoulders that are connected by adjustable straps to a lower band that surrounds the hips of the diver;

said expandable chamber can be filled with a mixture of breathable gas contained in a gas mix reserve of a self-contained breathing apparatus by a mechanical inflator that comprises an inlet that is connected to the reserve and is operated by a pushbutton inflation control; and said manifold is a tubular element that is provided with at least one upper one-way membrane, at least one lower one-way membrane, and at least one lateral one-way membrane, which is arranged in one of the ends of said lower band, one of which comprises said pushbutton inflation control and a control pushbutton that actuates said control valve.

2. The device according to claim 1, wherein said outlets are each constituted by a one-way membrane.

3. A buoyancy compensator device, comprising an expandable air chamber and at least two outlets, one arranged in an upper region and one arranged in a lower region, wherein:

a manifold connects said expandable air chamber to said outlets by means of a control value;

said expandable air chamber is a vest and is provided with two shoulders that are connected by adjustable straps to a lower band that surrounds the hips of the diver;

said expandable chamber can be filled with a mixture of breathable gas contained in a gas mix reserve of a self-contained breathing apparatus by a mechanical inflator that comprises an inlet that is connected to the reserve and is operated by a pushbutton inflation control; and said manifold is a tubular element that is provided with at least one upper one-way membrane, at least one lower one-way membrane and at least one lateral one-way membrane, which is arranged at the end of a corrugated hose, which is associated with said expandable chamber and accommodates a part of said manifold, said part being a tubular element.

4. The device according to claim 3, wherein said end of the corrugated hose comprises said pushbutton inflation control and a control pushbutton that actuates said control valve, which is also arranged in said end.

5. A buoyancy compensator device, comprising an expandable air chamber and at least two outlets, one arranged in an upper region and one arranged in a lower region, wherein:

a manifold connects said expandable air chamber to said outlets by means of a control valve;

said expandable air chamber is a vest and is provided with two shoulders that are connected by adjustable straps to a lower band that surrounds the hips of the diver;

said expandable chamber can be filled with a mixture of breathable gas contained in a gas mix reserve of a self-contained breathing apparatus by a mechanical inflator that comprises an inlet that is connected to the reserve and is operated by a pushbutton inflation control; and said manifold further comprises a central body and tubular elements that are connected respectively to at least one upper one-way membrane, to at least one lower one-way membrane, and to at least one lateral one-way membrane, which is arranged at one end of said lower band.

6. The device according to claim 5, wherein said end of the lower band comprises said pushbutton inflation control and an actuation pushbutton that actuates said control valve by means of a servo control.

7. The device according to claim 6, wherein said control valve is located at said central body and is actuated by a pneumatic servo control that is supplied, through a duct, by the gas mix that arrives from a reserve through said control pushbutton.

* * * * *